United States Patent [19]

Trabitzsch et al.

[11] Patent Number: 4,832,863

[45] Date of Patent: May 23, 1989

[54] LOW-FOAM PHOSPHATE-FREE DETERGENT

[75] Inventors: Uwe Trabitzsch, Ratingen; Helmut Grund, Haan, both of Fed. Rep. of Germany

[73] Assignee: Henkel Kommanditgesellschaft auf Aktien, Duesseldorf, Fed. Rep. of Germany

[21] Appl. No.: 137,202

[22] Filed: Dec. 22, 1987

[30] Foreign Application Priority Data

Dec. 31, 1986 [DE] Fed. Rep. of Germany ..... 3644808

[51] Int. Cl.[4] ..... C11D 1/86; C11D 1/83; C11D 1/66

[52] U.S. Cl. ..... 252/135; 252/174.25; 252/139; 252/540; 252/559; 252/174.21; 252/174.22; 252/DIG. 14

[58] Field of Search ..... 252/174.25, 135, 540, 252/559, 139

[56] References Cited

U.S. PATENT DOCUMENTS

| | | | |
|---|---|---|---|
| 4,072,621 | 2/1978 | Rose | 252/131 |
| 4,072,622 | 2/1978 | Kuehling et al. | 252/131 |
| 4,102,823 | 7/1978 | Matheson et al. | 252/533 |
| 4,169,075 | 9/1979 | Kuehling et al. | 252/558 |
| 4,438,012 | 3/1984 | Kuehling et al. | 252/131 |
| 4,675,124 | 6/1987 | Seiter et al. | 252/91 |

FOREIGN PATENT DOCUMENTS

| | | | |
|---|---|---|---|
| 588394 | 12/1959 | Canada . | |
| 2412837 | 10/1974 | Fed. Rep. of Germany | 11/8 |
| 2527388 | 6/1975 | Fed. Rep. of Germany . | |

*Primary Examiner*—Paul Lieberman
*Assistant Examiner*—Ronald A. Krasnow
*Attorney, Agent, or Firm*—Ernest G. Szoke; Wayne C. Jaeschke; Real J. Grandmaison

[57] ABSTRACT

A detergent composition which is distinguished by high detergency with respect to soil containing mineral oil and by low foaming both in the wash cycle and in the rinse cycle of automatic washing machines comprising (A) from 0.5 to 2% by weight $C_9$–$C_{13}$ alkyl benezenesulfonate, (B) from 10 to 15% by weight of a fatty alcohol or oxo alcohol containing 2 to 4 ethylene oxide groups, (C) from 4 to 8% by weight of a fatty alcohol or oxo alcohol containing 6 to 8 ethylene oxide groups, the alcohols in (C) and (D) containing 12 to 15 carbon atoms, (E) from 0 to 2% by weight of a saturated or mono-unsaturated $C_{16}$–$C_{18}$ alcohol containing 3 to 7 ethylene oxide groups, (E) from 5 to 20% by weight finely-divided crystalline zeolite, (F) from 40 to 60% by weight anhydrous sodium carbonate, (G) from 2 to 7% by weight sodium silicate and (H) from 0.5 to 2% by weight of a polymeric soil redeposition inhibitor.

18 Claims, No Drawings

LOW-FOAM PHOSPHATE-FREE DETERGENT

BACKGROUND OF THE INVENTION

Field of the Invention

This invention relates to a phosphate-free detergent which is particularly suitable for the washing of heavily soiled working apparel, for example soiled with mineral oil, and which does not generate troublesome quantities of foam when used in automatic washing machines. The detergent according to the invention is intended to foam only negligibly both in the main wash cycle and in the final rinse cycle, even under particularly critical conditions, i.e. even where it is used in softened water normally used in institutional laundries, so that no stoppage occurs in the automatic machines used in such laundries.

DESCRIPTION OF THE INVENTION

Other than in the operating examples, or where otherwise indicated, all numbers expressing quantities of ingredients or reaction conditions used herein are to be understood as modified in all instances by the term "about".

The present invention relates to a phosphate-free detergent comprising the following constituents:

(A) from 0.5 to 2% by weight of sodium alkyl benzenesulfonate containing linear $C_9$–$C_{13}$ alkyl chains;

(B) from 10 to 15% weight of a linear, primary $C_{12}$–$C_{15}$ alcohol containing 2 to 4 ethylene oxide groups or of a corresponding alcohol methyl-branched in the 2-position;

(C) from 4 to 8% by weight of a linear, primary $C_{12}$–$C_{15}$ alcohol containing 6 to 8 ethylene oxide groups or of a corresponding alcohol methyl-branched in the 2-position;

(D) from 0 to 2% by weight of a linear, saturated or monounsaturated, primary $C_{16}$–$C_{18}$ alcohol containing 3 to 7 ethylene oxide groups;

(E) from 5 to 20% by weight, based on anhydrous active substance content, of a water-containing, finely-divided crystalline zeolite of the NaA type;

(F) from 40 to 60% by weight of anhydrous sodium carbonate;

(G) from 2 to 7% by weight of sodium silicate having the ratio composition $Na_2O:SiO_2=1:2$ to 1:3.4;

(H) from 0.5 to 2% by weight of a water-soluble polymer having a soil redeposition-inhibiting effect; and (I) the balance, water and other non-surfactant or non-builder detergent constituents.

The detergent according to the invention preferably has the following composition, all precentages being percent by weight of the composition:

from 1 to 1.8% constituent A,
from 12 to 14% constituent B,
from 5 to 7.5% constituent C,
from 0.2 to 0.8% constituent D,
from 8 to 15% constituent E,
from 45 to 55% constituent F,
from 3 to 5.5% constituent G, and
from 0.8 to 1.5% constituent H. Constituent (A) comprises an alkyl benzenesulfonate which preferably contains 10 to 13 carbon atoms in the alkyl chain and which is normally referred to as dodecyl benezenesulfonate.

Constituent (B) contains from 12 to 15 carbon atoms in the alcohol residue and may be derived from natural or synthetic alcohols such as oxo alcohols. Oxo alcohols normally comprise a mixture of linear alcohols and alcohols methyl-branched in the 2-position wherein the linear alcohols preferably predominate. Preference is attributed to those which contain on average from 2.5 to 3.5 ethylene oxide groups.

Constituent (C) is derived from the same alcohols or alcohol mixtures as those of constituent (B), and preferably contains on average 6.5 to 7.5 ethylene oxide groups.

Of crucial importance to the desired low-foam effect is the finding that the proportion of $C_{12}$ alcohol, based on the alcohol residues in constituents (B) and (C), is less that 50% by weight, and that the detergent contains in all less than 2% by weight and preferably less than 1% by weight and more preferably from 0.2 to 0.8% by weight of ethoxylated $C_{16}$–$C_{18}$ alcohol.

Constituent (D) may be derived from natural and/or synthetic alcohols. Ethoxylated tallow fatty alcohols comprising a mixture of cetyl alcohol, stearyl alcohol and oleyl alcohol and containing from 3 to 7 and preferably from 4 to 6 ethylene oxide groups have proved to be particularly suitable.

Constituent (E) comprises a synthetic, water-containing zeolite NaA wherein at least 80% by weight and preferably more than 90% by weight consists of crystalline particles having a particle size below 10 μm and which does not contain any particles larger than 30 μm in size. The zeolite has a calcium binding power of 100 to 200 mg CaO/g, as determined in accordance with German Patent 24 12 837.

Constituent (F) comprises anhydrous sodium carbonate. Constituent (G) comprises sodium silicate wherein the ratio of $Na_2O$ to $SiO_2$ is from 1:2 to 1:3.4. Sodium silicates having a high $SiO_2$ content, i.e. those in which the ratio of $Na_2O$ to $SiO_2$ is from 1 : 3 to 1 : 3.4, are preferably used in quantities of at most 3 to 5% by weight, whereas sodium silicates in which the ratio of $Na_2O$ to $SiO_2$ is from 1:2 to 1:2.5 are used in quantities of at most 5 to 7 % by weight. Since the zeolite (constituent E) and the sodium silicate can interact to form relatively coarse zeolite agglomerates in highly concentrated aqueous mixtures such as slurries, constituents (E) and (G) are best added separately in the production of the detergent, the sodium silicate being added in dry form to the already dry zeolite-containing mixture or being introduced as an aqueous solution under non-agglomerating conditions.

Constituent (H) comprises a nonionic or anionic polymer having a soil redeposition-inhibiting effect. Cellulose ethers, such as sodium carboxymethyl cellulose, or mixtures thereof with other cellulose ethers, such as methyl cellulose, ethyl cellulose, hydroxyethyl cellulose, hydroxypropyl cellulose, or mixed ethers, such as methyl hydroxyethyl cellulose, methyl carboxymethyl cellulose or ethyl hydroxyethyl cellulose, are particularly suitable. Other suitable polymers include polyacrylic acid, copolymers of acrylic acid and vinyl ethers, copolymers of acrylic acid and maleic acid (Sokalan®) in the form of the sodium salts and other known copolymers of acrylic acid with copolymerizable olefinic compounds. Cellulose ethers and synthetic polymers may also be used together. Mixtures of carboxymethyl cellulose with methyl cellulose or methyl hydroxyethyl cellulose have proved to be particularly suitable.

Physically bound water or water bound as hydrate and also neutral salts, particularly sodium sulfate, may be used as a further non-surfactant or non-builder constituent (I). Enzymes, perfumes and powder flow-improving agents also belong to this group.

The detergent mixture may be prepared by spray drying from an aqueous slurry, by granulation, or even by mixing the granular to powder-form individual constituents together and adding the liquid nonionic surfactants or constituent (A) dissolved in water. As already mentioned, the zeolite and the sodium silicate are best processed separately. Constituent (E) may also be used in the form of a water-containing filter cake, such as the type obtained in the synthesis of zeolite, which is stabilized with suitable dispersion aids in accordance with the teaching of German Pat. No. 25 27 388. Suitable stabilizers include nonionic surfactants, more especially a compound of the type used for constituent (D), which is preferably introduced into the mixture in this form. After preparation, the blended detergent generally has a water content, including the water of hydration in constituent (E), of 6 to 10% of weight.

The detergent of this invention is generally used in a concentration of from 5 to 12 g/l and preferably in a concentration of from 8 to 10 g/l of softened water, i.e. water softened to a hardness of less than 2° Gh, and more especially to a hardness of less than 1° Gh, best being used to prepare the wash liquor.

EXAMPLE I

A detergent having the composition given below was evaluated for detergency and foaming properties. The nonionic surfactants of constituents B and C were derived from $C_{12}$–$C_{15}$ oxo alcohols. EO stands for moles added ethylene oxide. Constituent (E) was used in the form of an aqueous dispersion (solids content 50% by weight) and contained constituent (D) as a dispersion stabilizer. Constituent (H) consisted of a 2 : 1 mixture of sodium carboxymethyl cellulose and methyl hydroxyethyl cellulose having a hydroxyethyl content of 0.8% by weight. The mixture was converted into a granular powder by spray drying constituents (A) to (F) and (H) together and subsequently spraying thereon an aqueous solution of constituent (G).

The percentages indicated are percentages by weight based on anhydrous substance.

| | Constituent | % by weight |
|---|---|---|
| A | sodium dodecyl benzenesulfonate | 1.5 |
| B | $C_{12}$–$C_{15}$ alcohol + 3 EO | 13.2 |
| C | $C_{12}$–$C_{15}$ alcohol + 7 EO | 6.5 |
| D | tallow alcohol + 5 EO | 0.4 |
| E | zeolite NaA | 12.0 |
| F | sodium carbonate | 50.0 |
| G | $Na_2O:SiO_2$ (1:3.3) | 5.0 |
| H | cellulose ether | 1.2 |
| $I_1$ | sodium sulfate | 2.2 |
| $I_2$ | water | balance |

COMPARISON EXAMPLES

For comparison were prepared and evaluated detergents (C1 to C4) in which, for otherwise the same composition;

(C1) constituent (A) had been replaced by 1% by weight of constituent (B) and 0.5% by weight of constituent (C), (C2) constituents (A), (B) and (C) together had been replaced by a 1 : 1 mixture of tallow alcohol and oleyl alcohol +9.5 EO, (C3) constituents (B) and (C) has been replaced by a mixture of 2 parts by weight $C_{12}$–$C_{14}$ fatty alcohol +3 EO containing 65% $C_{12}$ alcohol, and 1 part by weight $C_{12}$–$C_{18}$ fatty alcohol +7 EO containing 20% $C_{16}$–$C_{18}$ fatty alcohol, (C4) constituents (A), (B) and (C) together had been replaced by a mixture of 2 parts by weight tallow alcohol +5 EO and 1 part by weight tallow alcohol +14 EO.

Washing conditions were as follows:

Front-loading automatic washing machine (model FRISTA ®); detergent concentration 10 g/l; charging ratio 1 : 14.5; ratio of kg fabrics to liter wash liquid 1 : 5; water hardness 0° Gh; prewash 20 minutes at 70° C.; clear wash 10 minutes at 50 to 60° C.; three rinses, two with softened water and the final rinse with tapwater.

Refined cotton (Cr) which had been soiled with used engine oil (mineral oil) was used as the test fabric. In a second series of tests, the following soil types were used:

Cr′=refined cotton soiled with dust-sebum,

CP=cotton/polyester blend soiled with dust-sebum, and

CrP=refined cotton/polyester blend soiled with dust-sebum.

The washing results are shown in Table 1. The foam height (in cm foam column above the liquid level) and the foam characteristic in the third rinse cycle are shown in Table 2.

Although comparison products C1 and C4 showed favorable foam behavior, they were unsatisfactory in regard to their detergency. Comparison product C2 foams vigorously in the main wash cycle and only slightly in the final rinse cycle, but does not approach the product according to the invention in regard to its detergency with respect to mineral oil. C3 shows a favorable cleaning effect with respect to mineral oil; however, its vigorous foaming during rising is an undesirable problem.

TABLE 1

| | % Remission | | | |
|---|---|---|---|---|
| | Cr | Cr′ | CP | CrP |
| Example I | 76.7 | 60.3 | 70.4 | 68.1 |
| $C_1$ | 75.0 | 52.3 | 66.2 | 63.9 |
| $C_2$ | 61.2 | — | — | — |
| $C_3$ | 76.6 | 54.3 | 60.0 | 66.0 |
| $C_4$ | 61.0 | — | — | — |

TABLE 2

| | Example | Maximum foam height (cm) | | | |
|---|---|---|---|---|---|
| | I | C1 | C2 | C3 | C4 |
| Prewash | 20 | 20 | 50 | 50 | 20 |
| Clear wash | 40 | 50 | 80 | 90 | 50 |
| Third rinse cycle | 0–10 | 10 | 10 | 20–30 | 1–10 |
| | large bubbles, unstable foam | large bubbles, unstable foam | large bubbles, unstable foam | small bubbles, stable foam | large bubbles, unstable foam |

We claim:

1. A phosphate-free, low-foaming detergent composition comprising:

(A) from about 0.5 to about 2% by weight of sodium alkyl benzenesulfonate containing linear $C_9$–$C_{13}$ alkyl chains;

(B) from about 10 to about 15% by weight of a linear, primary $C_{12}$–$C_{15}$ alcohol containing about 2 to about 4 ethylene oxide groups or of a corresponding alcohol methyl-branched in the 2-position;

(C) from about 4 to about 8% by weight of a linear, primary $C_{12}$–$C_{15}$ alcohol containing about 6 to about 8 ethylene oxide groups or of a corresponding alcohol methyl-branched in the 2-position, wherein the amount of $C_{12}$ alcohol, based on the alcohol residues in constituents (B) and (C), is less than about 50% by weight;

(D) from 0 to about 2% by weight of a linear, saturated or mono-unsaturated, primary $C_{16}$–$C_{18}$ alcohol containing about 3 to about 7 ethylene oxide groups;

(E) from about 5 to about 20% by weight, based on anhydrous active substance content, of a water-containing, finely-divided crystalline zeolite of the NaA type;

(F) from about 40 to about 60% by weight of anhydrous sodium carbonate;

(G) from about 2 to about 7% by weight of sodium silicate having the ratio composition $Na_2O : SiO_2 = 1:2$ to 1:3.4;

(H) from about 0.5 to about 2% by weight of water-soluble polymer having a soil redeposition-inhibiting effect; and (I) the balance, water and neutral salts.

2. A detergent composition as in claim 1 comprising, by weight;

from about 1 to about 1.8% of constituent A,
from about 12 to about 14% of constituent B,
from about 5 to about 7.5% of constituent C,
from about 0.2 to about 0.8% of constituent D,
from about 8 to about 15% of constituent E,
from about 45 to about 55% of constituent F,
from about 3 to about 5.5% of constituent G, and
from about 0.8 to about 1.5% of constituent H.

3. A detergent composition as in claim 1 wherein said alkyl benezen-sulfonate comprises dodecyl benezenesulfonate.

4. A detergent composition as in claim 1 wherein constituent B contains from about 2.5 to about 3.5 ethylene oxide groups.

5. A detergent composition as in claim 1 wherein constituent C contains from about 6.5 to about 7.5 ethylene oxide groups.

6. A detergent composition as in claim 1 wherein constituent D contains from about 4 to about 6 ethylene oxide groups.

7. A detergent composition as in claim 1 wherein at least about 80% by weight of constituent E has a particle size below 10 μm and none larger than 30 μm.

8. A detergent composition as in claim 1 wherein constituent H comprises a cellulose ether.

9. A detergent composition as in claim 1 wherein constituent H is selected from polyacrylic acid, a copolymer of acrylic acid and vinyl ether, a copolymer of acrylic acid and maleic acid, a copolymer of acrylic acid and an olefin compound, and mixtures thereof with a cellulose ether.

10. The process of producing a phosphate-free, low foaming detergent composition comprising (1) spray-drying, based on the anhydrous substance, (A) from about 0.5 to about 2% by weight of sodium alkyl benzenesulfonate containing linear $C_9$–$C_{13}$ alkyl chains;

(B) from about 10 to about 15% by weight of a linear, primary $C_{12}$–$C_{15}$ alcohol containing about 2 to about 4 ethylene oxide groups or of a corresponding alcohol methyl-branched in the 2-position.

(C) from about 4 to about 8% by weight of a linear, primary $C_{12}$–$C_{15}$ alcohol about 6 to about 8 ethylene oxide groups or of a corresponding alcohol methyl-branched in the 2-position, wherein the amount of $C_{12}$ alcohol, based on the alcohol residues in constituents (B) and (C), is less than about 50% by weight.

(D) from 0 to about 2% by weight of a linear, saturated or monounsaturated, primary $C_{16}$–$C_{18}$ alcohol containing about 3 to about 7 ethylene oxide groups;

(E) from about 5 to about 20% by weight, based on anhydrous active substance content, of a water-containing, finely-divided crystalline zeolite of the NaA type;

(F) from about 40 to about 60% by weight of anhydrous sodium carbonate; and (H) from about 0.5 to about 2% by weight of a water-soluble polymer having a soil redeposition-inhibiting effect; and (2) spraying on the spray-dried mixture based on the anhydrous substance, an aqueous solution of (G) from about 2 to about 7% by weight of sodium silicate having the ratio composition $Na_2O:SiO_2 = 1:2$ to 1:3.4.

11. The process as in claim 10 wherein said detergent composition comprises, based on the anhydrous substance, from about 1 to about 1.8% of constituent A,
from about 12 to about 14% of constituent B,
from about 5 to about 7.5% of constituent C,
from about 0.2 to about 0.8% of constituent D,
from about 8 to about 15% of constituent E,
from about 45 to about 55% of constituent F,
from about 3 to about 5.5% of constituent G, and
from about 0.8 to about 1.5% of constituent H.

12. The process as in claim 10 wherein constituent B contains from about 2.5 to about 3.5 ethylene oxide groups.

13. The process as in claim 10 wherein constituent C contains from about 6.5 to about 7.5 ethylene oxide groups.

14. The process as in claim 10 wherein constituent D contains from about 4 to about 6 ethylene oxide groups.

15. The process as in claim 10 wherein at least about 80% by weight of constituent E has a particle size below 10 μm and none larger than 30 μm.

16. The process of washing heavily soiled fabrics in an aqueous solution comprising contacting said soiled fabrics with a phosphate-free, low-foaming detergent composition comprising:

(A) from about 0.5 to about 2% by weight of sodium alkyl benzene sulfonate containing linear $C_9$–$C_{13}$ alkyl chains;

(B) from about 10 to about 15% by weight of a linear, primary $C_{12}$–$C_{15}$ alcohol containing about 2 to about 4 ethylene oxide groups or of a corresponding alcohol methyl-branched in the 2-position;

(C) from about 4 to about 8% by weight of a linear, primary $C_{12}$–$C_{15}$ alcohol containing about 6 to about 8 ethylene oxide groups or of a corresponding alcohol methyl-branched in the 2-position, wherein the amount of $C_{12}$ alcohol, based on the alcohol residues in constituents (B) and (C), is less than about 50% by weight;

(D) from 0 to about 2% by weight of a linear, saturated or mono-unsaturated, primary $C_{16}$–$C_{18}$ alcohol containing about 3 to about 7 ethylene oxide groups;

(E) from about 5 to about 20% by weight, based on anhydrous active substance content, of a water-containing, finely-divided crystalline zeolite of the NaA type;

(F) from about 40 to about 60% by weight of anhydrous sodium carbonate;

(G) from about 2 to about 7% by weight of sodium silicate having the ratio composition $Na_2O:SiO_2=1:2$ to 1:3.4;

(H) from about 0.5 to about 2% by weight of a water-soluble polymer having a soil redeposition-inhibiting effect; and (I) the balance, water and neutral salts.

17. The process as in claim 16 wherein said detergent composition comprises, by weight, from about 1 to about 1.8% of constituent A,
from about 12 to about 14% of constituent B,
from about 5 to about 7.5% of constituent C,
from about 0.2 to about 0.8% of constituent D,
from about 8 to about 15% of constituent E,
from about 45 to about 55% of constituent F,
from about 3 to about 5.5% of constituent G, and
from about 0.8 to about 1.5% of constituent H.

18. The process as in claim 16 wherein said aqueous solution comprises water softened to a hardness of less than 2° Gh.

* * * * *

UNITED STATES PATENT AND TRADEMARK OFFICE

CERTIFICATE OF CORRECTION

PATENT NO. : 4,832,863

DATED : May 23, 1989

INVENTOR(S) : Uwe Trabitzsch; Helmut Grund

It is certified that error appears in the above-identified patent and that said Letters Patent is hereby corrected as shown below:

At Col. 6, line 10, in claim 10, after "alcohol" add --containing--.

Signed and Sealed this

Twenty-seventh Day of March, 1990

*Attest:*

JEFFREY M. SAMUELS

*Attesting Officer*

*Acting Commissioner of Patents and Trademarks*